United States Patent [19]

Tucker

[11] Patent Number: 5,028,097

[45] Date of Patent: Jul. 2, 1991

[54] DISPENSER CABINET FOR DISPENSING SHEET MATERIAL

[75] Inventor: Council A. Tucker, Glendale, Calif.

[73] Assignee: James River Corporation, Oakland, Calif.

[21] Appl. No.: 371,598

[22] Filed: Jun. 26, 1989

[51] Int. Cl.[5] ..... B65H 19/00
[52] U.S. Cl. ..... 312/38
[58] Field of Search ..... 312/38, 39, 37

[56] References Cited

U.S. PATENT DOCUMENTS 464,378 12/1891 Morgan ..... 312/39 X
3,620,466 11/1971 Bump ..... 312/39 X

*Primary Examiner*—Joseph Falk
*Attorney, Agent, or Firm*—Thomas R. Lampe

[57] ABSTRACT

A dispenser cabinet for dispensing sheet material from a roll including support members supporting the ends of the roll and including distal end portions engaging the cabinet cover when the cover is closed and cooperable therewith the resist displacement of the support members from the roll ends.

5 Claims, 3 Drawing Sheets

DISPENSER CABINET FOR DISPENSING SHEET MATERIAL

TECHNICAL FIELD

This invention relates to a dispenser cabinet for dispensing sheet material from a wound roll of such material having bearing surfaces at opposed ends thereof. More particularly, the invention is directed to an improved arrangement for supporting the wound roll. Although the teachings of the present invention have applicability to dispenser cabinets for any type of wound roll product, it has special application to dispenser cabinets which dispense toweling from relatively large paper towel rolls.

BACKGROUND ART

A wide variety of dispenser cabinets for dispensing paper toweling from a roll are in commercial use. Conventionally, the paper towel rolls include bearing surfaces at opposed ends thereof. These bearing surfaces may, for example, simply comprise the open ends of a core incorporated in the roll. Other paper towel roll products exist wherein grooves or indents are formed in the paper toweling itself to form the bearing surfaces.

Regardless of the nature of the bearing surfaces incorporated in the paper towel roll product, it is well known to support the wound roll in a dispenser cabinet by means of support members attached to the cabinet housing and which include support elements engageable with the bearing surfaces at opposed ends of the wound roll to support the wound roll. During dispensing of toweling from the cabinet, the wound roll rotates on the support elements and gradually diminishes in size.

It will be appreciated that a wound roll will drop from its normal dispensing position within a cabinet if there is accidental disengagement between the bearing surfaces and the support elements. This unintentional drop-down can cause malfunctioning of the dispenser cabinet.

Inadvertent paper towel roll drop-down can occur in prior art cabinet constructions for a number of reasons. For example, a blow directed to the outside of the cabinet can cause dislodgment of the wound roll. This is particularly true if, as is often the case, the cabinet walls to which the support members are attached are constructed of relatively thin, somewhat flexible material such as plastic. Then too, a number of dispenser cabinets are adapted to dispense sheet material from a relatively large, heavy roll of material. For example, "jumbo" paper towel rolls having diameters in the order of eight inches or so are in widespread usage. The larger the roll, in general, the heavier it is, and such increased weight can also contribute to inadvertent dislodgment of the bearing surfaces from the support elements.

BRIEF SUMMARY OF THE INVENTION

The present invention relates to an arrangement for positively locking dispenser cabinet support elements in engagement with the bearing surfaces of the wound roll they are supporting. Even if a heavy wound roll is supported, or if an outside blow is applied to the cabinet, the support elements will not be dislodged. Further, the present invention includes a structural arrangement which facilitates manual loading of a wound roll into the cabinet.

A dispenser cabinet constructed in accordance with the teachings of the present invention includes a housing and support members attached to the housing. The support members include support elements engageable with the bearing surfaces of a wound roll of material at opposed ends thereof to support the wound roll. The support members have distal end portions spaced from the support elements thereof which may be manually grasped to control placement of the support elements relative to the wound roll.

A cover is connected to the housing and engageable by the distal end portions when the cover is in a closed position. The cover, when closed, cooperates with the distal end portions to maintain the support member support elements in engagement with the bearing surfaces and prevent displacement of the support elements away from the bearing surfaces.

Other features, advantages, and objects of the present invention will become apparent with reference to the following detailed description and accompanying drawings.

BEST MODE FOR CARRYING OUT THE INVENTION

Figure 1:
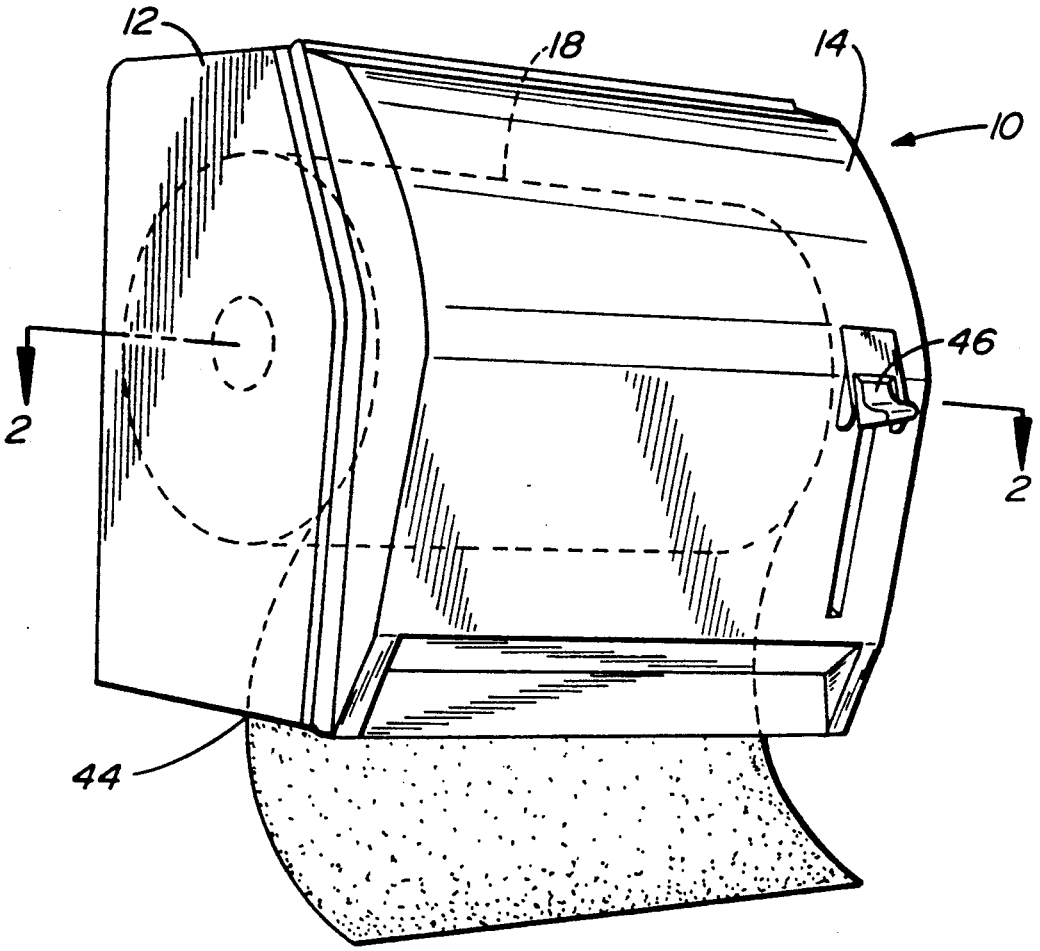
FIG. 1 is a perspective view of the outside of a closed dispenser cabinet constructed in accordance with the teachings of the present invention.

Referring now to the drawings, a dispenser cabinet constructed in accordance with the teachings of the present invention is designated generally by reference numeral 10. The cabinet 10 includes a housing 12 and a cover 14 pivotally mounted at the bottom thereof to the bottom of housing 12 in any known manner whereby the cover may be pivoted between an open position whereat the interior of the housing is accessible and the closed position illustrated in FIG. 1. The housing and cover may be constructed of any suitable material. Plastic is often utilized in the construction of components cf this nature. It will be appreciated that a suitable latch mechanism (not shown) is employed to maintain the cover in its illustrated closed position. Since such expedients are well known in the art, a latch has not been illustrated.

Figure 4:
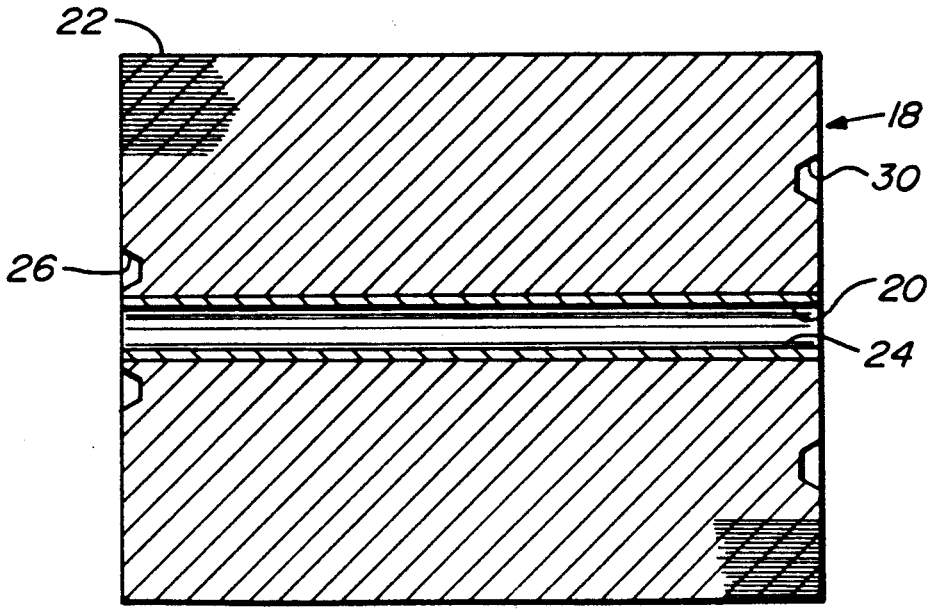
FIG. 4 is a cross-sectional view of a roll of sheet material adapted to be positioned in the dispenser cabinet for dispensing thereby.

Referring now specifically to FIG. 4, a roll product of the type to be dispensed from dispenser cabinet 10 is illustrated. The roll of sheet material shown in FIG. 4 is in the nature of a paper towel roll 18 comprising a core 20 about which has been wound a web of paper toweling 22. The roll has bearing surfaces at opposed ends thereof which are utilized to support the roll in cabinet 10.

At one end of the roll, the bearing surface is defined by the inner peripheral wall 24 of core 20. At the other end of the roll, the bearing surface is defined by a groove 26 formed in the toweling itself. The groove may be formed during winding of the toweling or simply cut into the rolled toweling by a suitable tool. In any event, the bearing surface or groove 26 is closely adjacent to core 20 and extends completely thereabout.

Figure 2:
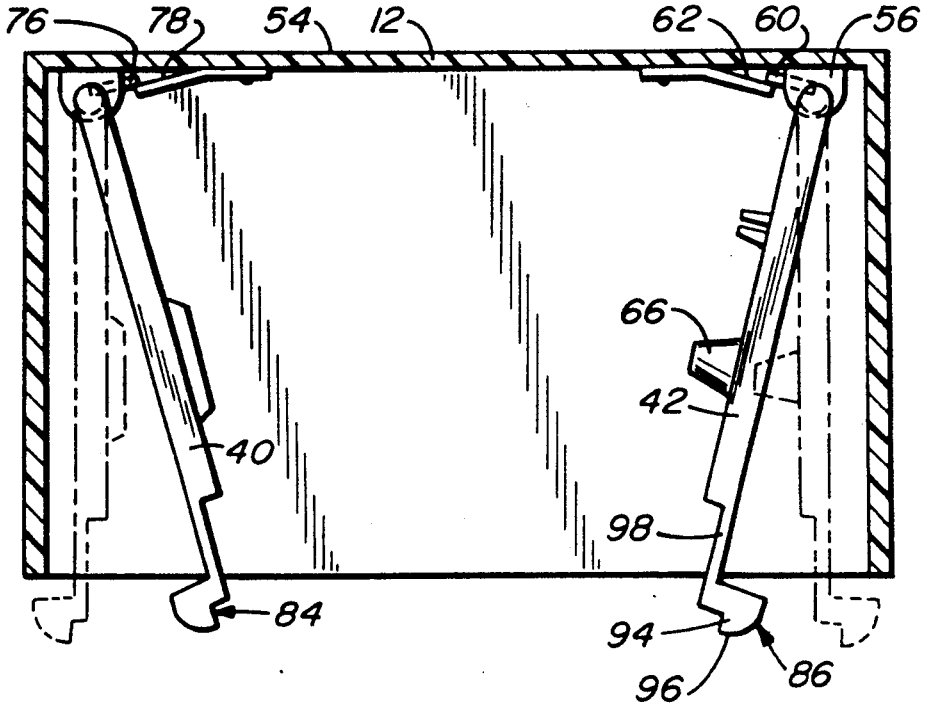
FIG. 2 is a diagrammatic, cross-sectional plan view of the cabinet housing taken along line 2—2 in FIG. 1 and illustrating the position assumed by support elements attached to the housing when not supporting a wound roll of sheet material.
Figure 2A:
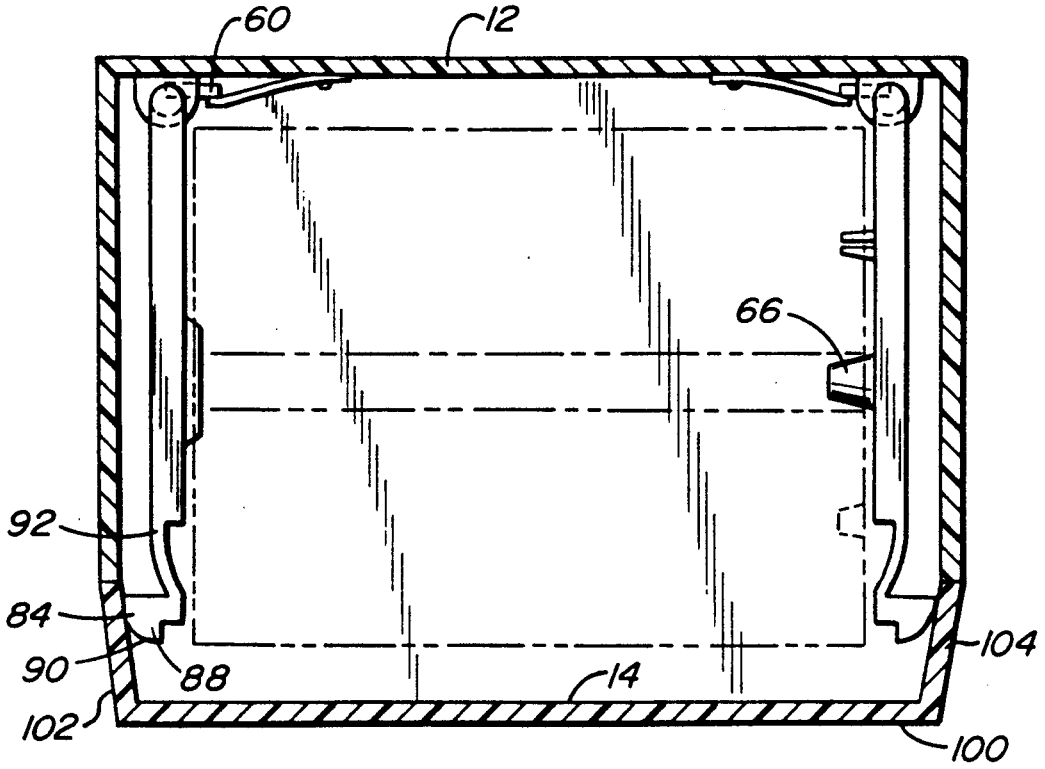
FIG. 2A is a view similar to FIG. 2 but illustrating the cooperative relationship existing between the dispenser cabinet support members and a cove: closed in position in engagement with the cabinet housing.

Paper towel roll 18 is adapted to be supported within the interior of cabinet 10 in the position illustrated in phantom in FIG. 1, as well as in FIG. 2A. Support is provided by support members 40, 42 in a manner soon to be described. In the arrangement illustrated, toweling 22 of the paper towel roll 18 projects downwardly through a slot 44 formed in the cover 14 whereby access is had to the toweling by the consumer. The location of the slot could, if desired, be located in housing 12.

It will be appreciated that a suitable mechanism (not shown) is disposed within the interior of the housing 12 to dispense the toweling from the cabinet. Such mechanism may, for example, be operated by an actuator lever 46 projecting from the cover 14. Since the precise mode of dispensing the toweling from cabinet 10 comprises no part of the present invention and such mechanisms are in widespread use in conventional towel dispensing cabinets, the mechanism will not be described, nor is it illustrated.

Figure 3:
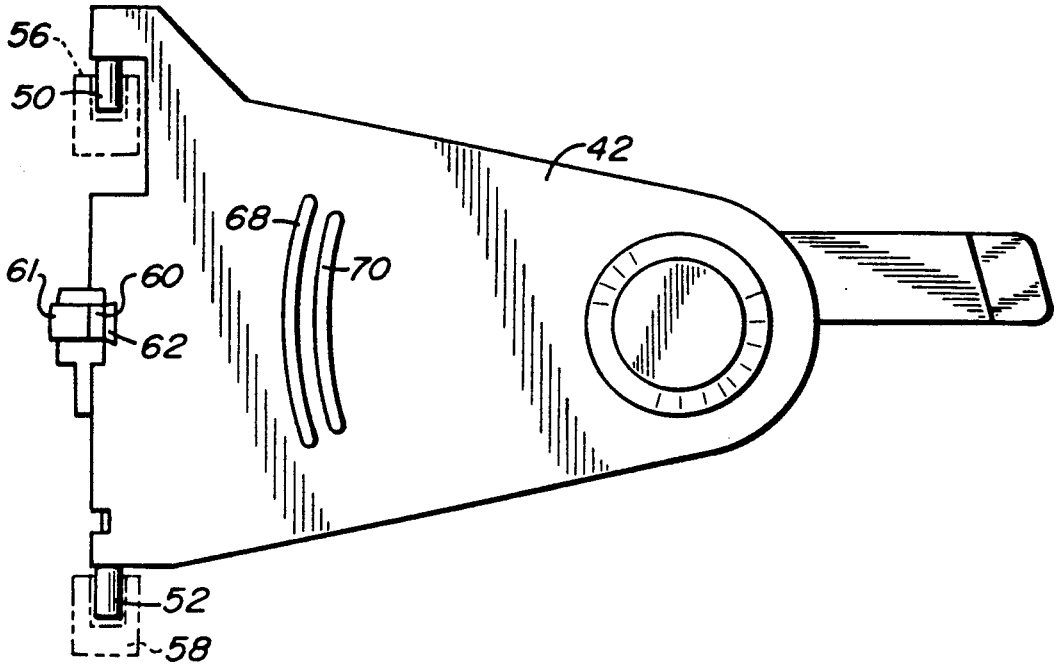
FIG. 3 is an enlarged, side view illustrating details of one of the support members.

Referring to FIGS. 2, 2A and 3, support member 42 is in the form of a double-ended arm. One end of the arm, the left end as viewed in FIG. 3, has pivot pins 50, 52 thereon. Pivot pins 50, 52 are positioned in suitable sockets attached to rear wall 54 of housing 12. These sockets are shown in phantom in FIG. 3 and identified by reference numerals 56, 58. The support member 42 is thus pivotally mounted relative to the housing. A tab 60 projects from the planer surface of the support member 42 and is continuously engaged by a spring 62 formed of spring metal or the like attached to wall 54. Thus, the support member 42 is continuously urged to the solid line position illustrated in FIG. 2 by the spring.

Support member 42 further includes a support element 66 in the form of a truncated cone. It will be appreciated that support element 66 is positionable into the core 20 of paper towel roll 18 and engages the bearing surface 24 to support the right end of roll 18 (as viewed in FIG. 2A).

Figure 3A:
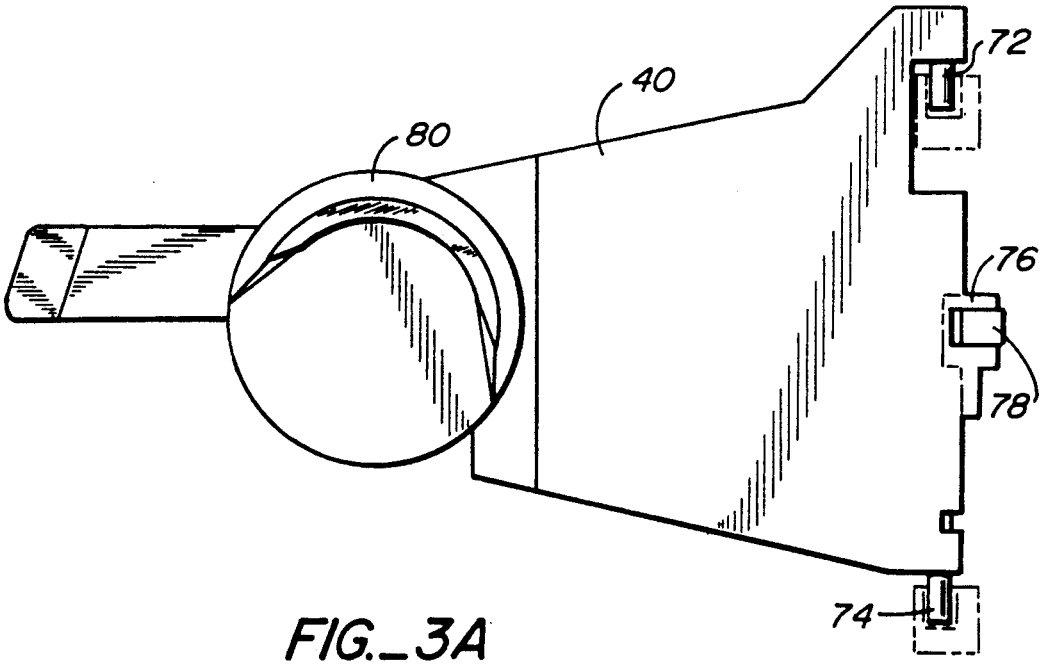
FIG. 3A is a view similar to FIG. 3 but illustrating the other of said support members.

Referring now also to FIG. 3A, support member 40 is also in a form of a double-ended arm with one of the ends thereof including pivot pins 72, 74 which are also mounted in suitable sockets on the housing rear wall 54. Like support member 42, support member 40 also includes a tab 76 in continuous engagement with a spring 78 mounted on rear wall 54. Support member 40 differs from support member 42 in that support member 40 has a support element 80 in the form of a generally semi-circular shaped body projecting from the planar surface of support member 40. Support element 80 is so configured as to enter groove 26 when the roll 18 is mounted in the cabinet. Support element 80, therefore, supports the left end of the roll as viewed in FIG. 2A.

Such an arrangement will enable the roll 18 to drop away from support element 80 when the convolutions of toweling 22 forming groove 26 are depleted during dispensing by the cabinet. This feature is known in the prior art and does not form part of the present invention. It will be appreciated that the principles of the present invention may, in fact, be applied to virtually any roll support arrangement incorporating support elements engageable with bearing surfaces at opposed ends of a wound roll to support same.

Support member 40 includes a distal end portion 84 which projects beyond housing 12. When the cover is open, the operator can manually grasp the distal end portion 84 and move it to the left, thus moving support member 40 clockwise (as viewed in FIGS. 2, 2A) against the urging of spring 78. A similar distal end portion 86 is incorporated in support member 42 and may be utilized to manually manipulate that support member as well. Thus, the paper towel roll 18 may be readily mounted in position in the housing.

Distal end portion 84 includes an enlarged head 88 defining a curved contact surface 90. Head 88 is attached to the rest of support member 40 by an arm section 92 having some degree of flexibility. Distal end portion 86 of support member 42 includes an enlarged head 94 defining a curved contact surface 96. Enlarged head 94 is connected to the rest of support member 42 by an arm section 98 also having some degree of flexibility.

When a towel roll is mounted in the cabinet housing 12, the support members 40, 42 assume the phantom line positions illustrated in FIG. 2. It will be noted that in such positions, the distal end portions of the support members project beyond the housing. Also, the enlarged heads 88, 94 extend somewhat beyond the inner surfaces of the housing side walls. When the cabinet cover 14 is brought to closed position in engagement with the housing 12 as illustrated in FIG. 2A, the cover will engage the contact surfaces defined by the enlarged heads 88, 94 and urge the distal end portions inwardly toward one another.

This arrangement locks the support members 40, 42 in engagement with the paper towel roll supported by them. In other words, the cover is in operative association with the support members and cooperable therewith to resist displacement of the support elements out of engagement with the roll bearing surfaces.

As may perhaps best be seen with reference to FIG. 2A, the front wall 100 of cover 14 is shorter than rear wall 54 of housing 12 and the side walls 102, 104 of the cover taper outwardly in the direction of the housing. This construction further results in the inward biasing of the distal end portions 84, 86. Arm sections 92, 98, being of somewhat reduced thickness relative to the rest of t he support members, will flex or bend as necessary to accommodate dimensional variations, a feature shown in highly exaggerated fashion in FIG. 2A. Alternatively, of course, the support members may be of substantially uniform thickness along the entire lengths thereof, in which case the support members would tend to flex or bend along such lengths

I claim:

1. In a dispenser cabinet for dispensing sheet material from a wound roll of said material having bearing surfaces at opposed ends thereof, the combination comprising:

a housing defining an interior and including side walls and a rear wall;

support members comprising spaced arms pivotally attached to said housing and disposed alongside said housing side walls, said spaced arms including support elements engageable with the bearing surfaces at opposed ends of said wound roll to support said wound roll within said housing interior, said support arms having distal end portions spaced from said support elements and extending outwardly beyond said housing interior, each said distal end portion defining a curved contact surface; and a cover including side walls, said cover connected to said housing and moveable between an open position whereat said housing interior is substantially open to a closed position whereat said housing interior is substantially closed, said distal end portions being engaged by said cover side walls when said cover is in said closed position and cooperable therewith to resist displacement of said support elements away from said bearing surfaces when said cover is closed, said cover side walls and said end portion curved contact surfaces being in sliding engagement when said cover moves from said open position to said closed position and cooperable during said sliding engagement to urge said distal end portions inwardly toward one another.

2. The combination according to claim 1 wherein said arms are flexible and bend when said distal end portions are urged inwardly toward one another when said cover moves from said open position to said closed position.

3. The combination according to claim 1 wherein said distal end portions include enlarged heads defining said curved contact surfaces and wherein said housing side walls have inner surfaces, said distal end portions at least partially extending beyond said housing side wall inner surfaces when said cover is in said open position.

4. The combination according to claim 3 wherein said support arms include flexible arm sections connected to said enlarged heads.

5. The combination according to claim 1 wherein said cover side walls taper outwardly in the direction of said housing.

* * * * *